United States Patent [19]

Smith

[11] 4,364,242

[45] Dec. 21, 1982

[54] METHOD OF REFRIGERATION AND A REFRIGERATION SYSTEM

[75] Inventor: Michael V. B. Smith, Sandton, South Africa

[73] Assignee: Engineering Management Services Limited, Transvaal Province, South Africa

[21] Appl. No.: 227,034

[22] Filed: Jan. 21, 1981

[30] Foreign Application Priority Data

Feb. 4, 1980 [ZA] South Africa ..... 80/0637

[51] Int. Cl.[3] ..... F25D 17/02

[52] U.S. Cl. ..... 62/99; 62/201; 62/434

[58] Field of Search ..... 62/99, 123, 201, 430, 62/434

[56] References Cited

U.S. PATENT DOCUMENTS 3,714,791 2/1973 Peck ..... 62/123

4,191,027 3/1980 Inoue ..... 62/201

OTHER PUBLICATIONS

"Engineering of refrigeration installations for cooling means", J. van der Walt-The S. African Mech. Eng., vol. 20, Oct. 1979, pp. 360-372.

*Primary Examiner*—Ronald C. Capossela

*Attorney, Agent, or Firm*—Ladas & Parry

[57] ABSTRACT

Liquid is cooled in a batch mode. A batch of liquid is circulated in a cooling loop (12) until it is cooled to a desired temperature at which time it is removed from the cooling loop (12) and a new batch is introduced therein. Preferably, the cooled batch is discharged from the cooling loop by the new batch with as little mixing as practicable. The cooling loop has a desired volume determined by a receiver (36) of suitable capacity. A supply accumulator (14) is used to accumulate liquid to be cooled and from which liquid to be cooled is supplied into the cooling loop. Cooled liquid is discharged from the cooling loop into a product accumulator (16). The liquid may be cooled to a temperature close to its freezing point by freezing a minor portion of the liquid in the cooling loop which is then melted by the liquid of the next batch when it is introduced into the cooling loop. The cooling loop is such as to promote plug flow and to reduce backmixing. In a preferred form, the cooling loop has an evaporative cooler (32) which utilizes a suitable refrigerant. The refrigerant is evaporated in each cooling cycle, at a progressively reducing pressure and temperature achieved by withdrawing liquid refrigerant from a closed first vessel (92), evaporating it in the cooler (32) to cool the liquid, compressing the vapor refrigerant by means of a compressor (76), condensing the vapor refrigerant in a condenser (80) and feeding the condensate into a further vessel (94). The liquid refrigerant is withdrawn initially into a flash tank (70), vapor being circulated by a pump (72) to the cooler (32). Valves (88, 90, 100 and 102) are provided to switch the two vessels (92, 94) around at the end of each cooling cycle.

18 Claims, 2 Drawing Figures

METHOD OF REFRIGERATION AND A REFRIGERATION SYSTEM

Figure 1:
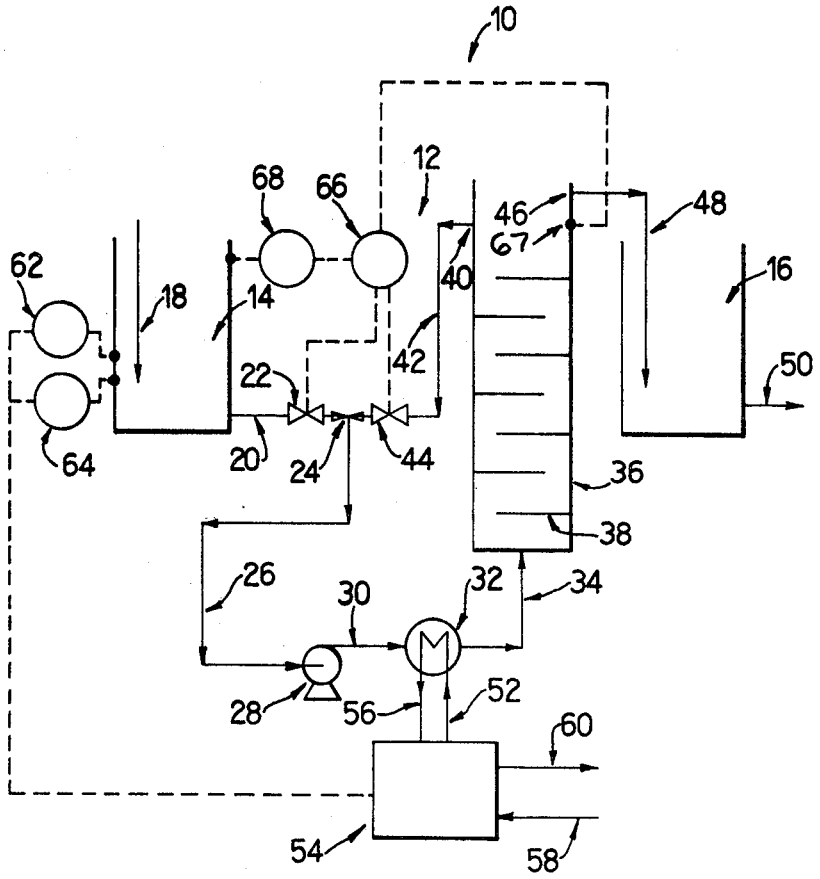

This invention relates, broadly, to refrigeration. More particularly it relates to a method of refrigeration, and to a refrigeration system.

The invention provides a method of cooling liquid which comprises:

circulating successive batches of the liquid around a series loop;

cooling each batch as it circulates around the loop; removing each batch from the loop when it has been cooled to a desired temperature; and simultaneously introducing the succeeding batch of liquid into the loop as the preceding batch is removed and in contact therewith with as little mixing as practicable between the batches.

By 'series loop' is meant an endless passage along which a batch of liquid can flow and around which it can circulate, parts of the batch of liquid following each other in series around the loop, apart from such incidental mixing as takes place.

In one form each batch in the loop may be displaced out of the loop by the succeeding batch.

Conveniently the cooling is to a desired temperature under a load which is at least potentially variable in terms of the supply rate and/or temperature of the liquid to be cooled and/or demand for cooled liquid, the method comprising:

accumulating the liquid to be cooled and/or the cooled liquid;

withdrawing the batches from the accumulated liquid to be cooled or from a substantially inexhaustible liquid source and feeding them successively into the loop; and cooling each batch to the desired temperature, the cooled batches displaced from the loop being accumulated or removed for use elsewhere.

When the liquid is cooled under a load which is variable in terms of the supply flow rate and/or temperature of the liquid to be cooled and/or demand for cooled liquid, the quantity of accumulated uncooled and/or cooled liquid will vary in response to changes in load, unless it is held approximately constant by suitable control of the cooling.

The cooling may be to a temperature which approaches the freezing point of the liquid as closely as possible, the method comprising:

cooling each batch until a minor portion thereof freezes; and using each succeeding batch to displace the unfrozen cooled liquid of the preceding batch from the loop and to melt said minor frozen portion.

Advantageously circulating each batch is such as to promote plug flow and to reduce backmixing thereof.

Cooling can be evaporative cooling using a refrigerant. By way of example, during the cooling of each batch, the refrigerant can be evaporated in a cooling cycle at a progressively reducing pressure and temperature the temperature difference between the evaporating refrigerant and the liquid being cooled being maintained at a substantially constant value, which will generally be small, e.g. about 5° C. Conveniently, evaporating the refrigerant at a progressively reducing temperature and pressure during the cooling cycle comprises withdrawing liquid refrigerant from a first vessel and evaporating it to effect the cooling, and then compressing and condensing refrigerant vapour produced by the cooling and feeding the condensate into a further vessel, the first vessel being closed so that a progressive pressure reduction occurs upstream of the compression with a correspondingly progressive reduction in temperature of evaporation over a predetermined period.

If desired the liquid refrigerant is withdrawn initially into a flash tank from which it is circulated via a loop to the evaporative cooling and from which tank the vapour passes to the compression, the further vessel being substantially the same volume as the first vessel and closed and the compression and condensation being such that, at the end of the cooling cycle substantially all the refrigerant has been transferred to the further vessel, and such that it is charged with liquid refrigerant at substantially the same temperature and pressure as the refrigerant in the first vessel at the start of the cooling cycle, to permit the functions of the vessel to be reversed during the succeeding cooling cycle to cool the succeeding batch.

It will thus be appreciated that as successive batches of liquid are cooled, the functions of the two vessels will be cyclically reversed, each cooling cycle lasting for as long as each batch is being cooled and reversal taking place when a cooled batch is displaced by the succeeding batch.

When the method involves freezing of a portion of each batch, as described above, the proportion of liquid frozen will be very small. This proportion, while remaining very small, may be sufficient to have a cleaning effect as described hereunder or to permit an exceptionally close approach to the freezing temperature of the liquid. The proportion of frozen liquid will however always be sufficiently small to be easily melted during the succeeding cycle and not to impair or impede the thermodynamic efficiency or heat transfer of the system.

Thus introduction of a succeeding batch to displace the prior batch may take place while circulation is suspended, and after the prior batch is removed, circulation of the succeeding batch is again started.

The invention also provides a refrigeration system for cooling liquid which comprises a refrigeration circuit arranged as a closed loop to permit circulation therethrough of liquid being cooled in a series loop, the circuit including circulation means for circulating liquid around the circuit and refrigerator means for cooling liquid as it circulates around the circuit, the circuit being adapted to contain a batch of liquid of a desired volume and having an inlet and an outlet and valve means to permit passage of a batch of liquid via the inlet into the circuit simultaneously as a preceding batch of liquid in the circuit is removed therefrom via the outlet from the circuit with as little mixing as practicable between the batches.

The circulation means may be located close to the inlet to permit each batch of liquid to displace the preceding batch from the circuit.

The circuit may be adapted to contain a batch of liquid of a desired volume by including a receiver of desired capacity. The system may include a supply accumulator means for accumulating liquid to be cooled and connected to the circuit by valve means, and a product accumulator for accumulating liquid which has been cooled, the accumulators being connected respectively to the inlet and the outlet of the circuit.

The valve means may thus be arranged to prevent circulation of liquid around the circuit, while permitting the circulation means to withdraw liquid from the supply accumulator means and into the circuit, thereby to displace liquid already in the circuit, to displace it from the circuit, or to isolate the supply accumulator means from the cicuit while permitting circulation. It will thus be appreciated that the valve means in the circuit will be adapted to close the circuit between the inlet and the outlet.

Each accumulator means may be a storage tank, and each valve means may comprise a shut off valve. The refrigerator means may comprise an evaporative cooler, and may comprise a shell and tube evaporator. The circulation means may be a pump.

The circuit can be so constructed to promote plug flow of liquid therethrough and to reduce backmixing.

The receiver may be a tank, provided with baffles or the like to promote plug flow of liquid therethrough and to avoid or reduce back mixing therein. It will be appreciated that, without the receiver, the volume of the circuit will in general be inconveniently small, unless its pipework etc. is of substantial length or unless small batches are to be cooled.

When the circuit includes a shut off valve as described above, the inlet to the circuit from the supply accumulator means will be between the shut off valve and the pump, upstream of the shut off valve; and the outlet of the circuit will be downstream of the pump and upstream of the shut off valve. The inlet and outlet may straddle the shut off valve, being closely spaced downstream and upstream therof respectively.

The outlet of the circuit may be a suitably located overflow, e.g. from the receiver, or it may comprise a valve, leading to the product accumulator means when this is provided.

The evaporative cooler may be arranged to evaporate refrigerant in a cooling cycle corresponding to the cooling of each batch, during which cycle the refrigerant is evaporated at a progressively reducing temperature and pressure.

The evaporative cooler may be connected to a conventional compression refrigeration apparatus or it may be connected to a pair of refrigerant vessels and a compressor and a condenser, the system including a valve arrangement permitting flow of liquid refrigerant from a first of the vessels to the evaporative cooler, and flow of refrigerant vapour from the evaporative cooler via the compressor and condenser to the further vessel. Conveniently, the system includes a flash tank to which the evaporative cooler is connected via a loop provided with means for circulating refrigerant from the flash tank to the evaporative cooler and back to the flash tank, the valve arrangement being such as to permit during a cooling cycle, the first vessel to discharge liquid refrigerant to the flash tank while the compressor receives refrigerant vapour from the flash tank and discharges via the condenser into the further vessel and to permit, during the succeeding cooling cycle, the further vessel to discharge liquid refrigerant into the flash tank while the compressor receives refrigerant vapour from the flash tank and discharges via the condenser into the first vessel.

A storage drum for refrigerant may be provided, connected for example via a reversible pump, to the liquid refrigerant feed from the vessel(s) to the flash tank, to supply or withdraw refrigerant, as necessary, to cater for variations in load.

Figure 2:
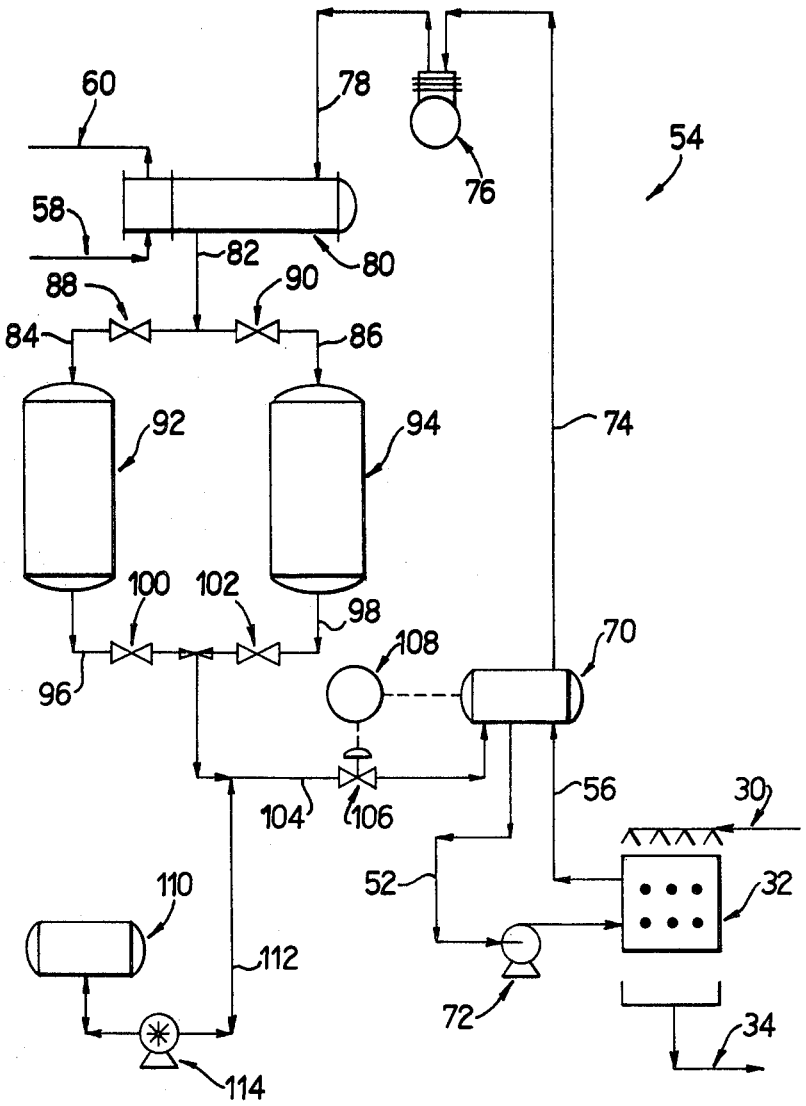

The invention will now be described, by way of example, with reference to the accompanying drawings, in which:

FIG. 1 shows a schematic diagram of a refrigeration system according to the invention; and FIG. 2 shows in detail a schematic diagram of the evaporator cooler of FIG. 1.

In FIG. 1 of the drawings, reference numeral 10 generally designates a refrigeration system in accordance with the invention. The system 10 comprises a refrigeration circuit generally designated 12, supply accumulator means in the form of a storage tank 14 upstream of the circuit 12, and a product accumulator means in the form of a storage tank 16 downstream of the circuit 12. The system shown is suitable for the refrigeration of water, for example in the refrigeration of brines or for the chilling of water to temperatures approaching its freezing point. The supply line for water to be cooled is generally designated 18, and discharges into the storage tank 14. The tank 14 discharges via flow line 20 provided with shut off valve 22, to the inlet to the circuit 12 at 24.

The circuit 12 comprises a flow line 26 leading from the inlet 24 to a pump 28, and a flow line 30 leading from the pump 28 to a heat exchanger in the form of an evaporator 32. The evaporator 32 discharges via a flow line 34 to a receiver tank 36 provided with baffles 38 for promoting plug flow therethrough. The tank 36 has an overflow at 40 to return water via flow line 42 provided with shut off valve 44 to the inlet at 24.

The tank 36 has an overflow at 46, at a higher level than the overflow at 40, for discharging water via flow line 48 to tank 16. The tank 16 has its discharge through flow line 50.

The evaporator 32 is provided with refrigerant via flow line 52 from a refrigeration unit 54 and returns refrigerant to said unit 54 via flow line 56. The unit 54 in turn receives refrigerant from means acting as a heat sink via flow line 58 and returns refrigerant to said heat sink via flow line 60.

The tank 14 is provided with a high level switch 62 and a low level switch 64, which are operatively connected to the refrigeration unit 54 and pump 28. The switches 62, 64 are relatively close to the floor of the tank 14 and are spaced vertically far enough apart so that the volume change in the tank associated with a change in level in the tank from one switch to the other is many times the volume of the tank 36. Switch 62 is operative to switch on the refrigeration unit 54 and pump 28 when the level of the switch 62 in the tank 14 is exceeded, and switch 64, correspondingly, is operative to switch off said unit and pump when the level in the tank 14 falls below the level of the switch 64. The increase in volume held by the tank 14 from the level of the switch 64 to the level of the switch 62 is sufficiently larger than the volume of the tank 36 (and hence the volume of the circuit 12) to ensure that switching does not take place too frequently.

Temperature switch 66 is provided to reverse the status of valves 22 and 44 from open to shut or vice versa. The element 67 operating the switch is located close to the level of the overflow point 40. It acts at a lower temperature related to the minimum temperature desired to shut valve 44 and open valve 22, and in the opposite sense (i.e. closing valve 22 and opening valve 44) at a selected higher temperature.

A high level switch 68 is provided at a level closer to the top of the tank 14. The function of this switch is (in response to the level of liquid in tank 14 reaching the height of switch 68) to reset the lower set point of the temperature switch 66 to a higher value such that the throughput of the system is increased, albeit at the expense of warmer chilled water, to keep up with supply to the tank 14. Switch 66 may be reset when necessary to its original value manually, or a further switch located close to but below switch 68, may reset the lower set point of temperature switch 66 automatically to its original value, when the liquid level in tank 14 subsequently drops.

The system of switches described may be modified in many ways, but the particular system described illustrates the potential simplicity of such a system and its lack of modulating controls. However, if the supply liquid is potentially always available from a very large reservoir, a corresponding set of switches may instead be provided on the cooled liquid reservoir 16, the controlled load variables then being supply liquid temperature and demand for cooled liquid.

The system 10 is suitable for the refrigeration of brines at varying loads i.e. at varying supply rates and/or varying temperatures and/or varying demand rates, and will now be described with reference to a method of refrigeration in accordance with the invention and suitable for such brines.

In accordance with the method, hot brine is received via flow line 18 into tank 14, and is accumulated in tank 14. When the hot brine level reaches switch 62, the unit 54 and pump 28 are switched on and a batch of accumulated hot brine is withdrawn from the tank 14 by the pump 28 into the circuit 12, until the circuit is filled. During this withdrawal the valve 22 in flow line 20 is open and the valve 44 in the flow line 42 is closed, the valve 22 having been closed during accumulation of hot brine in the tank 14.

When the circuit 12 has received its batch of brine, the element 67 of the switch 66 detects that the brine has exceeded the selected higher temperature and valve 22 is shut and the valve 44 is opened by the switch 66, and the brine is circulated by the pump 28 via flow lines 26, 30, 34 and 42 through the evaporator 32, tank 36 and valve 44, and thence via the flow line 26 back to the pump 28. In this regard it will be appreciated that in addition to the provision of baffles 38 in the tank 36, all the components of the circuit are as far as practicable designed to promote plug flow therethrough and to reduce back mixing.

When the desired minimum temperature in the circuit 12 is reached, the element 67 again detects this and the valve 44 is closed and the valve 22 is then opened by the switch 66. Valves 22 and 44 are never simultaneously open.

At this stage, the pump 28 will withdraw, via flow line 20, a further batch of brine from the tank 14. The succeeding batch of brine will pass through the circuit, and will displace the prior batch of brine from the circuit, raising its level in the tank 36 and removing it via the overflow 46 and flow line 48 to the tank 16. When the succeeding batch has displaced the prior batch from the circuit 12, the element 67 again detects this so that the valve 22 is closed and the valve 44 is opened by the switch 66, and the cycle is repeated. Cyclic operation of the system 10 continues in this batchwise fashion for as long as cooling of the brine is required or as long as the level in the tank 14 exceeds the level of the switch 64, cooled brine being withdrawn either continuously or from time to time as required from the tank 16.

It will be appreciated that the levels of brine in the tanks 14 and 16 will generally rise and fall cyclically over a small range in response to removal of batches of brine from the tank 14 and discharge of batches from the circuit 12 to the tank 16. Changes in levels in these tanks will also be responsive to changes in supply of hot brine (tank 14) and changes in demand for cold brine (tank 16). Changes in level are also responsive to changes in temperature of the hot brine from the flow line 18. An increase in temperature of the brine from the flow line 18 will tend to increase the level in the tank 14, and a decrease in this temperature will correspondingly tend to decrease the level in the tank 14, provided there are no compensatory changes in flow rate.

In practice, the system will be designed to handle a supply of hot brine through the flow line 18 at a given maximum supply rate and given maximum temperature, i.e. an anticipated maximum load. In exceptional circumstances above this combined maximum load, the level will rise above the high level switch 62. At design maximum load, the level in the tank 14 will remain between the levels of the switches 64 and 62.

In systems where the switch 68 is operative, and sustained operation above maximum load causes the level of liquid in the tank 14 to reach the height of the switch 68, the switch 68 acts to reset the lower set point of the switch 66 to a selected higher value to increase the throughput of the system. This increased throughput will be at the expense of a higher temperature for the chilled brine product. If the load subsequently drops so that the level in the tank 14 drops a further switch (e.g. switch 64 whose normal function is described hereunder) can be arranged to reset the lower set point of the switch 66 back to its original value.

At below the maximum load, the tank 14 will from time to time, more or less frequently, tend to empty. When the level of switch 64 in the tank is reached, circulation through the circuit 12 will be shut down to permit brine to accumulate in the tank 14, and the lower set point of the switch 66 will, if necessary be reset back to its original value.

If maximum load is exceeded, the level in the tank 14 will progressively rise, and it will be appreciated that operation at excess load can be tolerated if the switch 68 is absent or inoperative, provided operation above maximum load is for limited periods, and is followed by operation below maximum load before the tank 14 is filled, to permit its level to be dropped again. In this regard it will be appreciated that an excess load caused by excess flow rate load factor through the supply line 18 will merely fill the tank 14 faster than it can be emptied into the circuit 12, provided the load factor due to temperature is not compensatingly low. On the other hand, an excess load caused by excess temperature load factor in the brine from the flow line 18 will increase the cycle time of each batch in the circuit 12, once again resulting in supply of brine to the tank 14 gaining on the withdrawal of brine therefrom into the circuit 12, provided the load factor due to flow rate is not compensatingly low.

The flow induced by the pump 28 in the circuit 12 is designed to be a suitable multiple of the average throughput through the system 10 form the supply line 18 to the line 50. This multiple corresponds as regards energy efficiency to a plurality of like evaporators 32 arranged in series between the tank 14 and the tank 16, the multiple corresponding to the number of such evaporators, in a steady flow circuit.

Typically in brine or chilled water refrigeration installations, close attention is paid to energy economy and to control under partial or altered loads without excessive energy wastage. The applicant is aware of installations where a number of evaporators operating at progressively lower temperatures are arranged in series in the brine circuit, thereby minimizing lost work by keeping temperature difference between brine and refrigerant small and even. Control of such installations has been effected by shutting down successive evaporators in the series and/or by modulating controls applied to one or more such evaporators. Such modulating controls are generally incapable of maintaining full load efficiency when in use.

When flow rather than inlet temperature is expected to vary, the applicant is aware of systems where evaporators are arranged in parallel, the evaporators again being shut off as load diminishes. Thus full brine temperature drop occurs in each evaporator, with consequently loss of thermodynamic efficiency.

The present invention seeks to maintain optimum efficiency whatever the load, and irrespective of whether the load fluctuation is due to temperature or flow variation, or to both. It acts to avoid the use of modulating devices such as throttling valves, vane contols on centrifugal compressors, slide valves of screw compressors, or the like, which are inherently thermodynamically inefficient. Instead, during the treatment of each batch, all the components of the circuit operate at full load unless they are shut off.

The greater the flow rate through the circuit 12, when compared with the average flow rate through the system 10, the greater in principle the efficiency of the system 10. However, an economic balance must take into account the higher capital cost and pumping cost when the circulating flow rate is very high compared with the average throughput of the system 10.

It will further be appreciated that while only one of each of the components described in the system above will in principle be required, in practice more than one of each may be installed in parallel or in series.

An advantage of the invention is that series or parallel operation of refrigeration machines such as evaporators is not essential to cater for varying loads. A single evaporator can be used with attendant advantages of scale. Furthermore, the system provides a means of minimizing lost work in the evaporator caused by unfavourable temperature gradients.

A further advantage is that no modulating controls are required and the system responds simply to low load by shutting off the circuit 12 for an appropriate period. Short overload periods, e.g. those arising from diurnal conditions, can be tolerated without raising the cooled product temperature, provided they are followed or preceded by corresponding low load periods. The tank 14 can be made many times larger in volume than the tank 36 and circuit 12 and can have a substantial volume above the switch 62 if it is known that the load will exceed the maximum design load for some portion of a periodic (eg. daily) cycle. The volume above the switch 62 will accumulate liquid during an excess load period for subsequent cooling during a low load period. This leads to economy of equipment sizing, which then need not necessarily meet the highest instantaneous load to be encountered. Finally, the heat transfer surface required is in principle the same as that required for a series of evaporators with the advantage of being able to concentrate it in a single evaporator without loss of efficiency.

It should be noted that in a system in which the tanks 14 and 16 are externally connected through the ultimate refrigerated brine consumers, the tanks 14 and 16 should preferably be of the same size.

The invention will now be described further, with reference to the chilling of water to temperatures approaching its freezing point.

Operation of the system 10 is broadly in principle identical to operation thereof as described above with reference to brine, except that cooling of each batch in the circuit 12 is continued until a suitable thin layer of ice has formed on heat exchange surfaces, e.g. the surfaces in the evaporator 32 in contact with the water circulating around the circuit 12. This may be evidenced, for example, by outlet water temperature from the evaporator coupled with a suitable time delay which can be determined by calculation or empirically.

When such suitable thin layer of ice has been obtained, the cycle is repeated. Initially during the succeeding cycle, when uncooled water is admitted from the tank 14, the ice will be melted by the warmer water.

The evaporator 32 may in principle by of any type, e.g. the shell-and-tube type. When ice formation is contemplated, however, certain evaporators such as shell-and-tube evaporators may need special design to prevent mechanical damage caused by ice expansion upon freezing. Thus trickle-type plate coolers (also known as Baudelot coolers) may be preferred for use as evaporators. In these coolers water or brine to be cooled falls under gravity along the outside of a plate exposed to the atmosphere, and any ice formation cannot in principle exert large mechanical forces on the evaporator. Such coolers generally comprise pairs of vertical plates or banks of touching or closely spaced tubes forming a vertical plate surface with a suitable internal flow path for refrigerant and means for providing brine or water flow under gravity along the outside plate surface.

In chilled water refrigeration systems known to the applicant, the water so chilled is to a temperature generally not below 3° C. owing to the risk of undesired ice formation on heat transfer surfaces. In steady flow systems such ice can build up to a thickness where heat transfer is impeded and where in fact the danger exists of mechanically disrupting the heat transfer equipment owing to the expansive forces generated by ice formation. In practice, the heat transfer surfaces may be 2° C. below the temperature of the water being chilled, and when a safety margin is allowed, the minimum chilled water temperature generally encountered with standard equipment is of the order of 3° C. When special heat exchangers are used to chill water to slightly above 0° C., heat transfer efficiency is generally low, and large heat transfer surfaces are required.

In the present invention on the other hand, when the system and method are used to chill water close to its freezing point, the batchwise system of operation contemplates and tolerates freezing of a portion of the water of each batch, as the ice so caused is automatically melted during the initial part of the succeeding cycle.

The refrigeration unit represented generally by 54 in FIG. 1 may for example be a conventional compression or absorption refrigeration system or it may optionally and advantageously be a system as described below, with reference to FIG. 2 of the drawings in which, unless otherwise specified, the same reference numerals refer to the same parts as in FIG. 1.

In FIG. 2 the evaporator 32 is shown as part of a loop comprising the flow lines 52 and 56 and a flash tank 70. Means for circulating refrigerant around this loop is provided in the form of a pump 72 in the flow line 52. The flash tank 70 is in turn connected by flow line 74 to a compressor 76 which discharges via flow line 78 to a condenser 80. The condenser 80 in turn receives its own refrigerant in the form of cooling water from a heat sink via the flow line 58 and returns it to the heat sink via the flow line 60.

The condenser 80 has its condensate outlet connected to flow line 82 which divides into flow lines 84 and 86 provided respectively with shut off valves 88 and 90, and which lead respectively to refrigerant supply/collection vessels 92, 94. The vessels 92 and 94 in turn are respectively connected via flow lines 96 and 98, provided respectively with shut off valves 100 and 102, to flow line 104 which leads to the flash tank 70. Flow line 104 is provided with a control valve 106 responsive to a level controller 108 for the flash tank 70.

A refrigerant storage drum 110 is shown connected, via a flow line 112 provided with a reversible pump 114, to the flow line 104 on the side of the valve 106 remote from the flash tank.

The principle of the arrangement shown in FIG. 2, broadly, is the transfer of refrigerant from one container to another of equal size on a batch cycle in phase with the circulation cycle of the system 10 of FIG. 1. The container supplying the refrigerant remains throughout the cycle at a progressively reducing pressure which is slightly higher than that of the evaporator. (In this way compressor shaft work losses due to thermodynamic irreversibility at the expansion valve which would otherwise be required are substantially reduced, and the Carnot efficiency of the arrangement is substantially increased). At the end of the cycle refrigerant container functions are reversed, the receiver becoming the supply container and vice versa.

More specifically, at the beginning of each cycle i.e. when a batch of warm brine is starting to be introduced into the circuit 12 described with reference to FIG. 1, one of the vessels (containers) 92 or 94 (say 92 will be full of refrigerant at a temperature and pressure determined by cooling water temperature in flow line 58 and conditions in the condenser 80. The alternate vessel (say 94) will contain a small residue of cold refrigerant from the previous cycle. At the beginning of the cycle the valve arrangement constituted by valves 88, 90, 100 and 102 will have the following status:

valve 88 closed
valve 90 open
valve 100 open
valve 102 closed

An appropriate level of refrigerant is maintained in flash drum 70 by the use of the level controller 108 which is arranged to provide an appropriate supply of refrigerant from vessel 92 via flow lines 96 and 104. It should be noted that the pressure drop across valve 106 will be small, in fact just sufficient to maintain proper level control. It is therefore clear that this valve will not act as an expansion valve generating substantial quantities of flash vapour irreversibly and hence increasing the shaft work requirement at the compressor 76. Instead the low pressure drop and hence minimal flash vapour generation across the valve 106 will be maintained by virtue of the fact that the pressure in vessel 92 drops progressively over the cycle since it is isolated by closed valve 88 from the condenser 80 rather than being maintained at a high pressure set by condenser conditions.

Refrigerant is circulated from the flash drum 70 by the pump 72 through the evaporator 32 (shown as a plate cooler, which it however need not necessarily be) and flow lines 52, 56 and back to the flash drum 70, in which vapour generated in the evaporator is separated and passed along flow line 74 to the compressor 76. The compressor 76 compresses the vapour to a pressure suitable for condensation and feeds it via flow line 78 to condenser 80 where it is condensed. From the condenser 80, condensed refrigerant flows through flow line 82 and flow line 86 with open valve 90 to refrigerant vessel 94 where it accumulates over the cycle.

During the cycle the brine becomes progressively colder as is described above with reference to FIG. 1. In phase with this the refrigerant being evaporated becomes pregressively colder because the refrigerant pressure is dropping progressively. The temperature of the refrigerant will for most of the cycle be lower than the temperature of the brine by an amount determined mainly by the area and heat transfer characteristics of the evaporator but also to some extent by the thermal inertia of the cold refrigerant mass.

When the brine has reached the desired low temperature level, refrigerant vessel 94 becomes the supply vessel and vessel 92 the receiver vessel by changing of valve status to the following:

valve 88 open
valve 90 closed
valve 100 closed
valve 102 open

The cycle is then repeated, at the end of which the receivers again reverse functions, and so on.

For most efficient operation it will be necessary that at the end of each cycle the refrigerant in the supply vessel (92 or 94 as the case may be) is nearly depleted. This can be achieved by periodic adjustment (increase or reduction) of the refrigerant quantity in the working system by using pump 114 and storage drum 110.

The advantage of the arrangement of FIG. 2 is that all of the process steps can in principle be designed to approach thermodynamically reversible behaviours and hence the shaft work of the compressor 76 can be reduced to approach the thermodynamic minimum. This is in contrast to conventional systems where inherently thermodynamically irreversible devices such as expansion valves are utilized.

A further advantage of the invention as a whole is that, for a simple system having all the advantages described above with reference to brine cooling, water can be obtained at a temperature very close to freezing. In many cases, such as mine refrigeration, this permits substantial economies both in running and in the capital cost of the distribution system and application system of the cold water, compared to a system using water at say 4° C.

A further advantage is that in principle a single refrigeration machine such as a single evaporator can be used to generate water at near freezing point without any thermodynamic energy penalty due to large temperature differences in the evaporator.

Furthermore, if the water to be chilled has a fouling tendency as in mine refrigeration applications, the extent of fouling can be minimized due to the repeated formation on, and removal from, the heat exchange surface of ice. The mechanical action of this formation and removal can act to remove such scale as is formed.

The system and method of the invention which involves ice formation is likely to have its greatest application in mine refrigeration where large quantities of water are used, and where surface fouling is a problem, as a close approach to freezing point in the chilled water has important economic advantages. It will however be appreciated that the system and method of the present invention, both as regards brine chilling and the cooling of water close to its freezing point will have other applications, including those where the liquid is neither water nor a mixture containing water, but is one which tends to deposit a crystalline phase at low temperatures, with consequent impediment to heat transfer or danger of mechanical disruption.

I claim:

1. A method of cooling a liquid by circulating successive batches of liquid through a refrigeration circuit, which method comprises:

introducing each batch in turn into the refrigeration circuit;

when the batch has been introduced into the circuit, closing the circuit to form a closed series loop around which the batch can circulate;

circulating the batch around the series loop;

when the batch has been cooled to a desired temperature, opening the circuit to permit said batch to be removed from the circuit and to permit a succeeding batch simultaneously to be introduced into the circuit; and removing said cooled batch from the circuit while simultaneously introducing the succeeding batch into the circuit, the batches being in contact with each other with as little mixing as practicable therebetween.

2. A method as claimed in claim 1, in which each batch in the loop is displaced out of the loop by the succeeding batch.

3. A method as claimed in claim 1, in which the cooling is to a desired temperature under a load which is at least potentially variable in terms of the supply rate and/or temperature of the liquid to be cooled and/or demand for cooled liquid and which comprises:

accumulating the liquid to be cooled and/or the cooled liquid;

withdrawing the batches from the accumulated liquid to be cooled or from a substantially inexhaustible liquid source and feeding them successively into the loop; and cooling each batch to the desired temperature, the cooled batches displaced from the loop being accumulated or removed for use elsewhere.

4. A method as claimed in claim 1 in which the cooling is to a temperature which approaches the freezing point of the liquid as closely as possible, which comprises:

cooling each batch until a minor portion thereof freezes; and using each succeeding batch to displace the unfrozen cooled liquid of the preceding batch from the loop and to melt said minor frozen portion.

5. A method as claimed in claim 1, in which circulating each batch is such as to promote plug flow and to reduce backmixing thereof.

6. A method as claimed in claim 1, in which the cooling is by evaporative cooling using a refrigerant.

7. A method as claimed in claim 6, in which, during the cooling of each batch, the refrigerant is evaporated in a cooling cycle at a progressively reducing pressure and temperature, the temperature difference between the evaporating refrigerant and the liquid being cooled being maintained at a substantially constant value.

8. A method as claimed in claim 7, in which evaporating the refrigerant at a progressively reducing temperature and pressure during the cooling cycle comprises withdrawing liquid refrigerant from a first vessel and evaporating it to effect the cooling, and then compressing and condensing refrigerant vapour produced by the cooling and feeding the condensate into a further vessel, the first vessel being closed so that a progressive pressure reduction occurs upstream of the compression with a correspondingly progressive reduction in temperature of evaporation over a predetermined period.

9. A method as claimed in claim 8, in which the liquid refrigerant is withdrawn initially into a flash tank from which it is circulated via a loop to the evaporative cooling and from which tank the vapour passes to the compression, the further vessel being substantially the same volume as the first vessel and closed and the compression and condensation being such that, at the end of the cooling cycle substantially all the refrigerant has been transferred to the further vessel, and such that it is charged with liquid refrigerant at substantially the same temperature and pressure as the refrigerant in the first vessel at the start of the cooling cycle, to permit the functions of the vessel to be reversed during the succeeding cooling cycle to cool the succeeding batch.

10. A refrigeration system for cooling liquid, which comprises a refrigeration circuit arranged as a closed series loop to permit circulation around it of liquid being cooled in a series loop, the circuit including circulation means for circulating liquid around the circuit and refrigerator means for cooling liquid as it cirulates around the circuit, the circuit being adapted to contain a batch of liquid of a desired volume and having an inlet and an outlet and valve means operable either to close the circuit to form the closed series loop or to open the circuit to permit passage of a batch of liquid via the inlet into the circuit simultaneously as a preceding batch of liquid in the circuit is removed therefrom via the outlet from the circuit with as little mixing as practicable between the batches.

11. A system as claimed in claim 10, in which the circulation means is located close to the inlet to permit each batch of liquid to displace the preceding batch from the circuit.

12. A system as claimed in claim 10, in which the circuit is adapted to contain a batch of liquid of a desired volume by including a receiver of desired capacity.

13. A system as claimed in claim 10, which includes a supply accumulator means for accumulating liquid to be cooled and connected to the circuit by valve means, and a product accumulator for accumulating liquid which has been cooled, the accumulators being connected respectively to the inlet and the outlet of the circuit.

14. A system as claimed in claim 10, in which the circuit is constructed to promote plug flow of liquid therethrough and to reduce backmixing.

15. A system as claimed in claim 10, in which the refrigerator means comprises an evaporative cooler.

16. A system as claimed in claim 15, in which the evaporative cooler is arranged to evaporate refrigerant in a cooling cycle corresponding to the cooling of each batch, during which cycle the refrigerant is evaporated at a progressively reducing temperature and pressure.

17. A system as claimed in claim 16, in which the evaporative cooler is connected to a pair of refrigerant vessels and a compressor and a condenser, the system including a valve arrangement permitting flow of liquid refrigerant from a first of the vessels to the evaporative cooler, and flow of refrigerant vapour from the evaporative cooler via the compressor and condenser to the further vessel.

18. A system as claimed in claim 17, which includes a flash tank to which the evaporative cooler is connected via a loop provided with means for circulating refrigerant from the flash tank to the evaporative cooler and back to the flash tank, the valve arrangement being such as to permit during a cooling cycle, the first vessel to discharge liquid refrigerant to the flash tank while the compressor receives refrigerant vapour from the flash tank and discharges via the condenser into the further vessel and to permit, during the succeeding cooling cycle, the further vessel to discharge liquid refrigerant into the flash tank while the compressor receives refrigerant vapour from the flash tank and discharges via the condenser into the first vessel.

* * * * *